United States Patent [19]

Schoenwetter et al.

[11] Patent Number: 4,715,104

[45] Date of Patent: Dec. 29, 1987

[54] INSTALLATION TOOL

[75] Inventors: Randall R. Schoenwetter, Waukesha; John Makal, Menomonee Falls; Edward L. Sankey, New Berlin, all of Wis.

[73] Assignee: RTE Corporation, Waukesha, Wis.

[21] Appl. No.: 908,843

[22] Filed: Sep. 18, 1986

[51] Int. Cl.[4] ..... B25B 27/14

[52] U.S. Cl. ..... 29/271

[58] Field of Search ..... 29/270–272, 29/264, 278; 411/395, 386

[56] References Cited

U.S. PATENT DOCUMENTS

| | | | |
|---|---|---|---|
| 1,366,963 | 2/1921 | Schweinert et al. | 411/395 X |
| 1,394,608 | 10/1921 | Davern | 29/271 X |

FOREIGN PATENT DOCUMENTS

| | | | |
|---|---|---|---|
| 19448 | 10/1914 | France | 411/386 |
| 504630 | 12/1954 | Italy | 29/270 |
| 81103 | 7/1934 | Sweden | 29/264 |

*Primary Examiner*—Robert C. Watson

[57] ABSTRACT

An installation tool for mounting a loadbreak reducing tap plug in a high voltage "T"-type connector of the type including a cable connector having a threaded opening, the plug having a threaded end adapted to be mounted in the threaded opening of the cable connector and a threaded bolt extending through the threaded end of the plug, the threaded bolt having a wrenching opening and being rotated by a wrenching tool for connecting the plug to a bushing, the installation tool comprising a shaft having a threaded end corresponding to the threaded opening in the connector and a threaded opening corresponding to the threaded bolt, whereby the threaded end of the installation tool can be mounted in the threaded opening in the connector, the threaded bolt can be mounted in the threaded opening in the installation tool, and the threaded end of the plug can be drawn into alignment with the threaded opening in the connector when the installation tool is backed out of the threaded opening in the connector.

2 Claims, 5 Drawing Figures

58
50
10
53
52
54
56
59

50
58
10
53
52
54
56
59

20
14
26
30
16
28
34
36
22
24
32
18

INSTALLATION TOOL

BACKGROUND OF THE INVENTION

The present invention relates to the assembly of a load break reducing tap plug to a threaded cable connector located in a visible break "T" connector housing. Visible break "T" connectors are used to establish a visible ground connection to the circuit elements of a high voltage power distribution circuit. The installation of a load break reducing tap plug into the visible break housing is accomplished by inserting the reducing tap plug into the "T" housing and axially aligning the threaded end of the plug with the threaded opening in the cable connector. Once aligned the plug is rotated to screw the threaded end into the threaded opening. Due to the size of the plug and the "T" connector, it is difficult to accurately align the threaded end of the tap plug with the threaded opening in the cable connector resulting in cross-threading of the plug and connector.

SUMMARY OF THE INVENTION

The installation tool of the present invention has been designed to enable the lineman to quickly and easily align the threaded end of the plug into the threaded connector opening and thus eliminate cross-threading. The installation tool is provided with a threaded end corresponding to the threaded opening in the connector and a threaded bore provided in the threaded end of the installation tool which corresponds to the threaded mounting bolt in the load break reducing tap plug. Installation is achieved by initially screwing the installation tool into the threaded opening in the connector and aligning the installation tool with the axis of the bushing interface opening. The bolt in the plug is then screwed into the threaded opening in the installation tool. The installation tool is then backed out of the connector in order to draw the threaded end of the plug into axial alignment with the threaded opening in the cable connector. The plug is then rotated as the installation tool is backed out in order to draw the threaded end of the plug into the threaded opening in the connector.

IN THE DRAWINGS

DESCRIPTION OF THE INVENTION

Figures 1, 2:
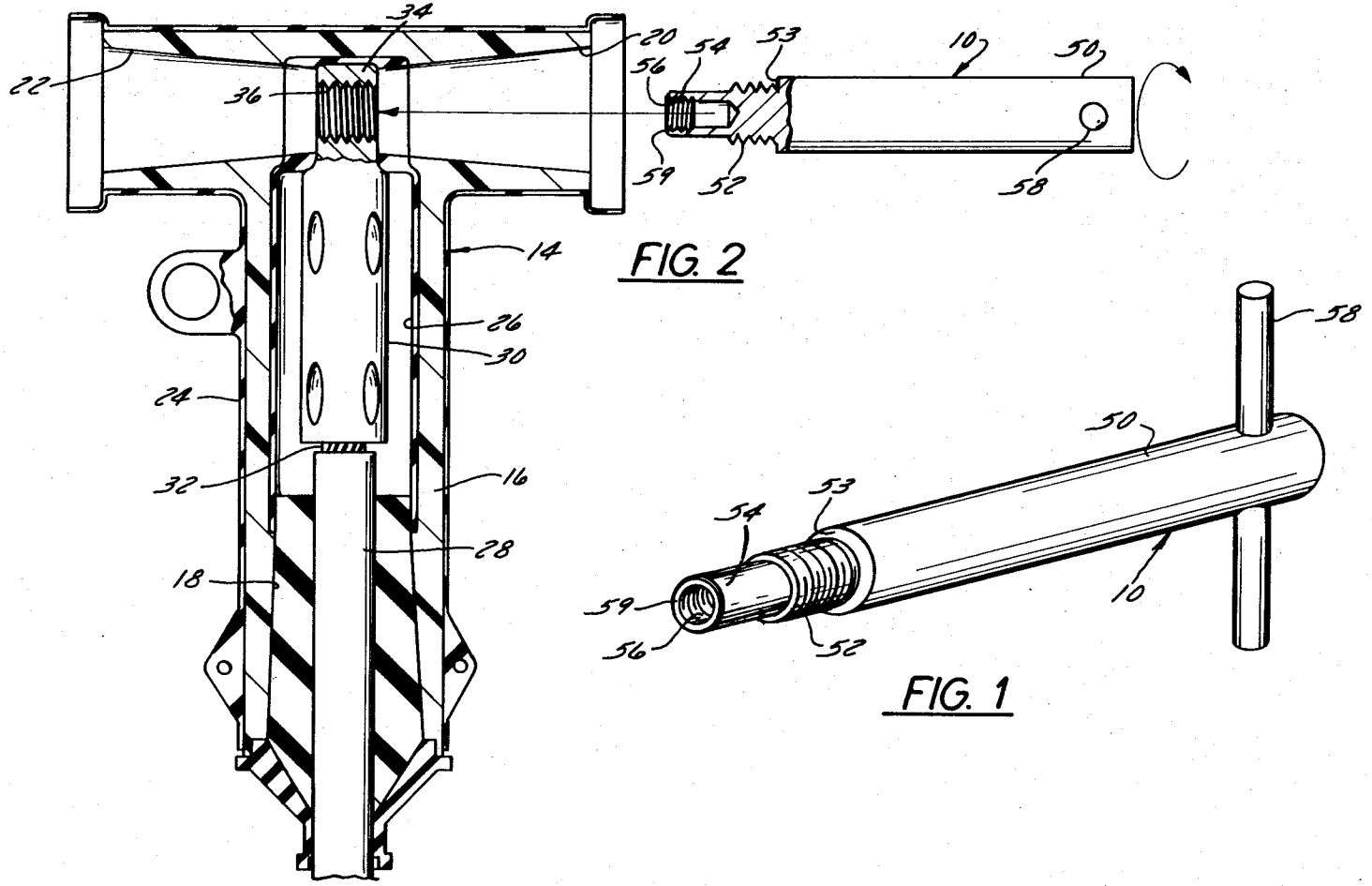
FIG. 1 is a perspective view of the assembly tool according to the present invention.
FIG. 2 is an exploded side elevation view showing a cross section of the "T" connector with the assembly tool aligned in the bushing interface opening in the "T" connector housing.
Figure 3:
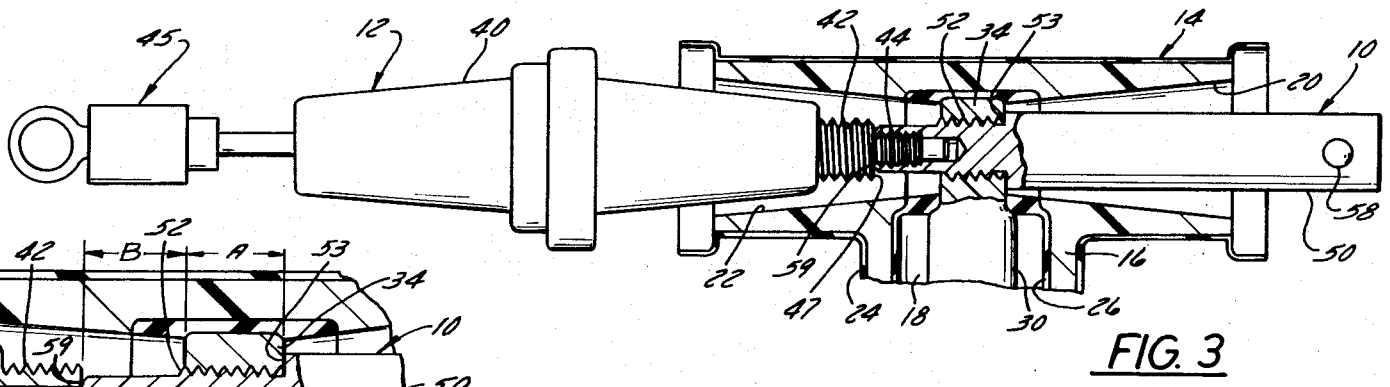
FIG. 3 is a view partly in section showing the reducing tap plug mounted on the installation tool.
Figure 4:
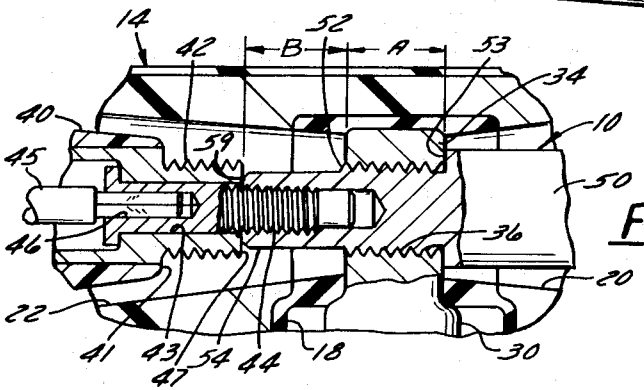
FIG. 4 is a cross section view of the reducing tap plug installation tool and cable connector showing the alignment of the mounting bolt in the threaded opening of the installation tool.

The installation tool 10 according to the present invention is used to align a load break reducing tap plug 12 into a cable connector 30 located in a visible break "T" connector 14. In order to assemble the plug 12 in the "T" connector 14, the installation tool 10 is mounted in the "T" connector and the plug 12 is attached to the end of the installation tool. The installation tool is then backed out of the "T" connector to draw the reducing tap plug into the "T" connector until the plug engages the cable connector 30. The plug is then rotated to screw the plug into the "T" connector.

The visible break "T" connector 14 includes a dielectric housing 16 of conventional configuration having a cable opening 18, a bushing interface opening 20 and a plug interface opening 22. A conductive sheath 24 is provided on the outer surface of the housing 16 and a conductive liner 26 is provided in the cable opening 18. A high voltage cable 28 is inserted into the opening 18 with the cable connector 30 mounted on the cable conductor 32. The cable connector 30 includes a lug 34 at the end having a threaded opening 36, which is aligned with the bushing interface opening 20 and the plug interface opening 22.

The load break reducing tap plug 12 is also of conventional configuration having a dielectric housing 40 which has an outer configuration corresponding to the bushing interface opening 22. A threaded electrically conductive tubular member 42 having an axial opening 43 is provided on the end 47 of the housing 40 which is adapted to be received in the threaded opening 36 provided in the lug 34. A threaded brass bolt 44 is provided in the opening 43 for attaching the plug and "T" connector to a transformer bushing. A wrenching opening 46 is provided in the head of the bolt to accommodate a torque tool 45.

The installation tool 10 includes a cylindrical shaft 50 having a threaded extension 52 extending beyond the shoulder 53. The threaded extension 52 corresponding to the diameter of the threaded opening 36 in the lug 34. A tubular extension 54 is provided on the end of the threaded end 52 of the tool 10. A threaded opening 56 is provided in the extension 54 which corresponds to the threaded bolt 44. A handle 58 is mounted on the other end of the shaft 50 for rotating the installation tool.

The plug 12 is mounted in the "T" connector 14 by initially inserting the installation tool 10 into the bushing interface opening 20. The threaded end 52 is screwed into the threaded opening 36 until the shoulder 53 engages the lug 34. The installation tool 10 is used to align the axis of the opening 36 with the axis of the bushing interface opening 20 and the plug interface opening 22.

The torque tool 45 is then inserted into the housing 40 until the end of the tool 45 is aligned in the wrenching opening 46 in the bolt 44. The plug is then aligned in the plug interface opening 22 and the bolt 44 is turned into the opening 56 until the end 47 of the threaded section 42 abuts the end 59 of the tubular member 54. It should be noted that the length "B" of the member 54 should be greater than the width "A" of the lug 34 to allow alignment of threaded section 42 with opening 36 after the threaded end 52 clears the opening 36.

Figure 5:
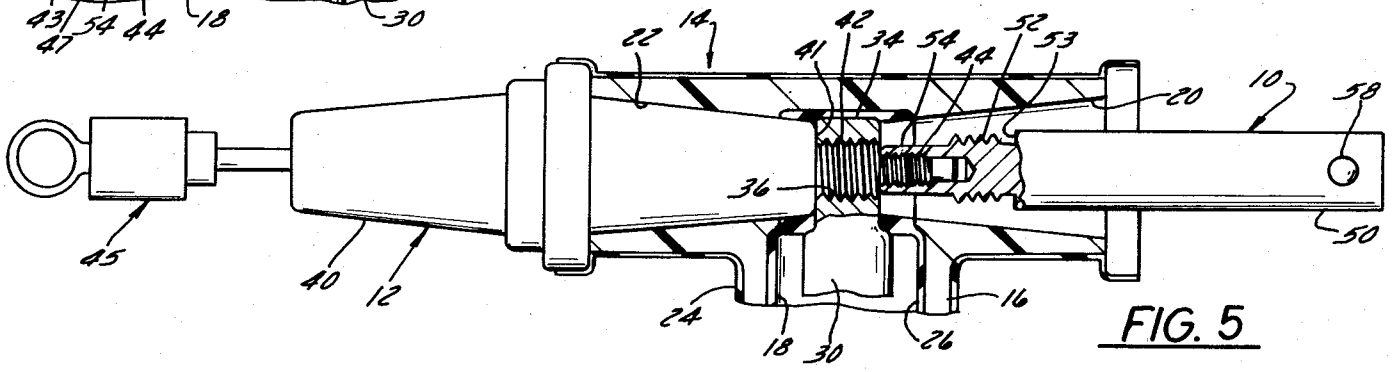
FIG. 5 is a view of the load break reducing tap plug connected to the cable connector and seated in the plug interface opening in the "T" connector housing.

The assembly tool 10 is then rotated counterclockwise to withdraw the threaded end 52 from the opening 36 in the lug 34. The plug 12 will be drawn into the interface opening 22 with the threaded end 42 aligned with the threaded opening 36. As the threaded section 52 of the tool 10 clears the end of the opening 36, the housing 40 is rotated to screw the threaded end 42 into the threaded opening 36. The housing 40 should be rotated until the shoulder 41 is seated on the lug 34 as seen in FIG. 5. Once the housing is seated in the interface opening 22, the torque tool 45 is rotated counterclockwise to remove the bolt 44 from the opening 56 in the assembly tool.

The embodiments of the invention in which an exclusive property or privilege is claimed are defined as follows.

1. An installation tool for aligning the threaded end of a load break reducing tap plug with the threaded opening in a cable connector mounted in a visible break "T" connector assembly, the plug including a mounting bolt mounted in the threaded end of the plug, said tool comprising an elongated shaft having a threaded section on one end corresponding to the threaded opening in the cable connector, a non-threaded tubular extension on the threaded end of the shaft, the extension having a length greater than the width of the cable connector, and a threaded opening in the tubular extension and corresponding to the mounting bolt in the reducing tap plug.

2. An installation tool for mounting a loadbreak reducing tap plug in a high voltage "T"-type connector of the type including a cable connector having a threaded opening, the plug having a threaded end adapted to be mounted in the threaded opening of the cable connector and a threaded bolt extending through the threaded end of the plug, the threaded bolt having a wrenching opening and being rotated by a wrenching tool for connecting the plug to a bushing, said installation tool comprising a shaft having a threaded end corresponding to the threaded opening in the connection, a non-threaded tubular extension on the threaded end of said shaft, and a threaded opening in the tubular extension and corresponding to the threaded bolt, whereby the threaded end of said installation tool can be mounted in said threaded opening in said connector, said threaded bolt can be mounted in said threaded opening in said installation tool, and said threaded end of the plug can be drawn into alignment with said threaded opening in said connector when said installation tool is backed out of said threaded opening in said connector.

* * * * *